United States Patent [19]

Vines

[11] 4,129,680

[45] Dec. 12, 1978

[54] CHROME DENTAL ALLOY

[75] Inventor: Raymond F. Vines, Chatham, N.J.

[73] Assignee: Sterndent Corporation, Mount Vernon, N.Y.

[21] Appl. No.: 440,059

[22] Filed: Feb. 6, 1974

[51] Int. Cl.[2] ..... B32B 7/06; E05D 15/00; E05D 15/26; A61C 5/12

[52] U.S. Cl. ..... 428/433; 32/63; 29/160.6; 29/527.6; 29/527.3; 29/527.4; 29/527.7

[58] Field of Search ..... 29/160.6, 527.5, 527.6, 29/527.3, 527.4, 527.7; 164/DIG. 4; 75/126 C, 126 R, 134 F, 171; 161/213, 406; 32/63; 428/433

[56] References Cited

U.S. PATENT DOCUMENTS

| | | | |
|---|---|---|---|
| Re. 20,877 | 10/1938 | Prange | 75/171 X |
| 2,617,725 | 11/1952 | Owens et al. | 75/134 F |
| 2,680,081 | 6/1954 | Probert et al. | 29/527.5 UX |
| 3,192,583 | 7/1965 | Fryrear | 164/34 |
| 3,544,315 | 12/1970 | Asgar | 75/171 |
| 3,685,115 | 8/1972 | Scott | 29/160.6 |
| 3,727,299 | 4/1973 | Hoffmann et al. | 29/160.6 X |
| 3,756,809 | 9/1973 | Asgar | 75/134 F |
| 3,758,299 | 9/1973 | Ennis et al. | 75/171 |
| 3,761,728 | 9/1973 | Kochavi | 29/160.6 |
| 3,837,838 | 9/1973 | Mohammed | 75/134 F |

OTHER PUBLICATIONS

ASM Metals Handbook, 8th Ed., vol. 4, pp. 432–437, "The Forming of Nickel Alloys".

ASM Metals Handbook, 8th Ed., vol. 5, pp. 101, 106, 119–121, 140–142, Published by ASM, Metals Park, Ohio.

Unitek Corp. Catalog No. 113, Cr 1964, pp. 10, 18, 31, 42, 43, Published by Unitek Corp., Monrovia, Calif.

*Primary Examiner*—C.W. Lanham
*Assistant Examiner*—V. K. Rising
*Attorney, Agent, or Firm*—Pennie & Edmonds

[57] ABSTRACT

A process is disclosed for producing chrome alloys in a form suitable for casting dental appliances. A chrome dental alloy which is inherently capable of being processed, prior to casting the appliance, to wrought form by hot working is first fused to form a melt in a heating means (e.g., an electron beam hearth) which substantially excludes the presence of or substantially removes tramp elements (e.g., carbon, oxygen and nitrogen). The melt is then cast into an ingot which is subsequently hot-worked to form a shaped piece (e.g. bar, strip, rod or wire). The shaped piece is next cut into small weight pieces of predetermined size convenient for handling by dental laboratories and the pieces are coated with water glass (e.g., sodium silicate) so as to protect the pieces from contamination with tramp elements during the heating period preparatory to melting and casting into dental appliances.

5 Claims, 1 Drawing Figure

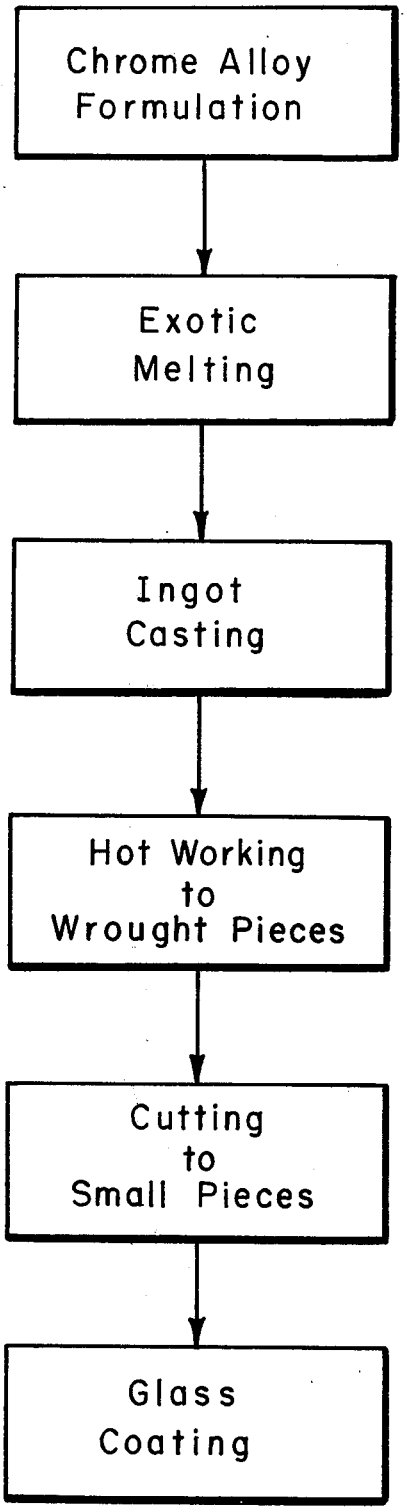
Chrome Alloy Formulation
Exotic Melting
Ingot Casting
Hot Working to Wrought Pieces
Cutting to Small Pieces
Glass Coating

CHROME DENTAL ALLOY

BACKGROUND OF THE INVENTION

This invention relates to alloys for use in casting dental appliances. More particularly, it relates to chromium-containing alloys and a process for producing same in a form suitable for use in casting dental appliances and capable of being processed, prior to casting, to wrought form by hot working.

Gold alloys have traditionally been the material of choice among dental laboratories for use in making cast restorations such as denture bases, partial dentures, crowns and bridgework. These alloys are usually formulated by dental gold manufacturers in accordance with American Dental Association specifications and supplied to dental laboratories in the form of rolled strip cut to exact weight pieces for remelting and casting into dental appliances using heated molds.

Over the years, as a result of rising gold prices, base metal alloys have been sought after as a substitute for dental gold. An early example of such non-noble metal alloys are the cobalt/chromium alloys, introduced in 1933. These alloys, and others developed more recently, exhibit resistance to corrosion in the mouth comparable to that possessed by gold alloys. For example, according to J. R. Lane, *A Survey of Dental Alloys,* J. Am. Dental Assn., 39, 414–437 (1949), this corrosion resistance is due in large part to the presence of chromium in the base metal alloy, a chromium content in excess of 18 percent by weight being generally effective for this purpose. Unlike dental gold, however, cobalt/-chromium alloys are undesirably hard and exhibit low ductility. Thus, undue hardness makes finishing (e.g., grinding and polishing) difficult and expensive, while low ductility complicates adjustment of the finished appliance by the dentist. Another unattractive feature of these alloys is their higher melting temperatures compared to gold alloys. Furthermore, cobalt/chromium alloys cannot be easily wrought or rolled into small weight pieces as can the gold alloys. Instead, they are supplied as small cast ingots for remelting and casting into dental appliances. However, the use of wrought alloy rather than cast ingots by dental laboratories is desirable because the former possesses a number of advantages. Thus, the use of wrought alloys for casting in heated molds results in cast dental appliances of sufficient ductility to permit adjustment by dentists and dental technicians. Wrought alloy can be made in larger melts under controlled conditions which provides greater melt-to-melt uniformity. Additionally, wrought material permits production of the small shaped pieces by mechanical means, which in turn permits cost reduction.

Although cobalt/chromium alloys have over the years established a secure position in the dental appliance field, their use has been generally restricted to the casting of relatively large appliances, primarily because of the aforesaid drawbacks (low ductility and high finishing cost) in the properties of these alloys. However, the recent dollar devaluations and establishment of the two-tier gold price system have intensified the need for base metal alloys suitable for all types of dental castings, both large and small.

Among the newer base metal alloys showing promise in the dental field are the iron/chromium, iron/nickel/-chromium, and nickel/chromium alloys. These newer chrome alloys, like the older cobalt/chromium alloys, are stronger, lighter in weight, more resistant to staining and, of course, less expensive than the gold alloys. Although the higher melting temperatures of the newer base metal alloys are a disadvantage insofar as the production casting of dental appliances is concerned, their major drawback resides in the sensitivity of these alloys with regard to ductility and workability to the presence of even miniscule amounts of so-called "tramp" elements, namely, carbon, oxygen and nitrogen. The problem is particularly irksome in dentistry because the aforesaid impurities are difficult to control in the small foundry melts of ingots used in casting appliances. According to Skinner and Phillips, *The Science of Dental Materials,* page 583 (W. B. Saunders Co. 1967), the control of carbon content is most critical, since small variations thereof can have a pronounced effect on the strength, hardness and ductility of the alloy. Carbon can react with the metallic components of the alloy to form carbides. These carbon-metal compounds can dramatically alter the alloy's useful properties of strength and ductility as well as increase the difficulty of finishing the cast appliance.

The control of carbon in chromium/base metal alloys is exceedingly difficult during both the manufacture of ingots and their use by dental laboratories in casting procedures. This is also true when a flame is used during casting whereupon an undesirable amount of carbon is usually incorporated into the alloy. Even assuming that the carbon content of the alloy can be controlled satisfactorily, the additional problem of contamination during the melting and casting stages with oxygen and nitrogen from the atmosphere must be dealt with. As a result, the production of base metal dental alloys has in practice been restricted to the casting of unwrought, small ingots weighing about 5-grams following the pattern set by the earlier cobalt/chromium alloys notwithstanding the inherent capability of the newer alloys to be hot-worked to form wrought pieces. This fact has severely limited the economic benefits which would otherwise be realized in replacing gold altogether in the dental field. Heretofore, efforts at overcoming the aforementioned obstacles have been directed primarily at introducing compositional variations in existing chrome alloys, for example, by the addition of special elements or agents. The work described in K. Asgar and B. O. Techow, *A New Alloy for Partial Dentures,* J. Prosthetic Dentistry, 23(1), 36–43 (January, 1970) typifies these efforts. However, for a variety of reasons, the above-described problems have yet to be solved in a commercially acceptable manner through the introduction of new alloys. A need therefore exists, not for a new alloy, but rather, for an economical process whereby conventional chrome alloys can be cast and hot-worked into small wrought pieces of quality comparable to that presently enjoyed by gold.

Accordingly, it is an object of the present invention to provide a process for making alloys in a wrought form suitable for remelting and casting into dental appliances of adequate strength and ductility.

Another object is to provide a process for the production casting of chrome alloys from wrought pieces into dental appliances which are free from deleterious amounts of tramp elements such as carbon, nitrogen and oxygen.

Another object is to provide chrome alloy wrought pieces which are initially free of deleterious amounts of tramp elements and which can be used in the casting of both large and small dental appliances without contamination by deleterious impurities.

These and other objects of the invention, as well as a fuller understanding thereof can be had by reference to the following detailed description, drawing, and claims.

SUMMARY OF THE INVENTION

The foregoing objects are achieved according to the present invention wherein the following procedure has been discovered for the manufacture of wrought chrome alloy pieces and their use by dental laboratories in making cast dental appliances. First, a chrome alloy is selected or formulated so that the resulting composition is suitable for use in the mouth and at least capable of being processed, as gold alloys are, to wrought form by casting and subsequent conventional hot working procedures. The selected alloy composition is then melted in a manner so as to substantially avoid contact with or substantially remove tramp elements (e.g., oxygen, nitrogen and carbon). The molten metal is then cast into an ingot which is later hot worked or wrought to form a shaped bar, strip, rod or wire. The surface oxides formed during hot working should be removed prior to the next step. Such removal can be accomplished by conventional means. Small pieces are then cut from the wrought ingot and coated with a glass derived from a water-soluble glass-forming compound thereby minimizing contamination thereof with tramp elements during melting in dental laboratories preparatory to casting the alloy into dental appliances using heated molds.

The process of the present invention is applicable to a variety of conventional chrome alloys used for making cast dental restorations, specifically those chrome alloys which have sufficient ductility, even if only after controlled melting in the manner described hereinabove, to permit economic working from large ingot to bar, rod, strip, or wire. In general, the chromium content should be at least about 20 percent by weight and preferably between about 20 percent and about 30 percent by weight to ensure resistance to tarnish and corrosion in the mouth. The other major elements can be, individually or in combination, iron, nickel or, less desirably, cobalt, the latter element generally reducing the ductility. Some advantage is offered by the chrome/iron alloys in that they are single phase ferritic and have a lower coefficient of expansion than the austenitic alloys. However, austenitic alloys of chromium/iron/nickel and chromium/nickel are also useful. They have somewhat lower melting points, higher coefficients expansion and are non-magnetic. As is known to those skilled in the art, hardening and strengthening element such as tungsten, molybdenum, columbium, tantalum, aluminum and titanium may be added where desired.

The melting of the selected chrome alloy prior to casting into ingots can be achieved according to the present invention by the use of a heating means which substantially excludes the presence of or substantially removes tramp elements. Preferred types of heating means include vacuum melting, electron beam hearth refining, or argon-oxygen decarburization melting techniques. This step permits the reduction to non-deleterious levels of the interstitial or tramp elements such as carbon, oxygen or nitrogen which are known to decrease ductility and workability of both the resulting ingot and the finished cast appliance.

The techniques of vacuum melting, electron beam hearth refining, and argon-oxygen decarburization are well-known in the art. A description of the argon-oxygen decarburization process, for example, is given in W. A. Krivsky, *The Linde Argon Oxygen Process for Stainless Steel; A Case Study of Major Innovation in a Basic Industry,* Metallurgical Transactions, 4, pages 1439–1447 (June 1973).

The application of vacuum melting to cobalt/chromium alloys is mentioned in F. R. Morral, *Cobalt Alloys as Implants in Humans,* J. Materials, 1(2), pages 384–412 (June 1966). However, the use of these exotic melting techniques for the melting of the small pieces preparatory to casting dental appliances is impractical. Because of limitations of scale, operations such as vacuum melting, electron beam hearth refining or argon-oxygen decarburization used in the first melting stage of the process of this invention are impractical in the final melting stage. However, it has been discovered that material to be melted in the final stage of the process is sensitive to contamination during the overall melting operation, and that at least a portion of this contamination can be avoided by preliminarily coating the small alloy pieces in glass to achieve substantial exclusion of tramp elements. Coating is desirably accomplished according to the present invention through the use of a water-soluble glass-forming compound by dipping the wrought ingot into an aqueous solution of said compound, followed by drying. Preferably, the pieces are coated with "water glass" formed from an alkali metal silicate (e.g., sodium silicate) or an alkali metal borate (e.g., sodium borate). This feature of the present invention protects the wrought chrome alloy during the heat-up to the melting temperature; the glass coating material is sufficiently fluid at the casting temperature in the heated mold to be displaced by the metal thereby avoiding interference with metal flow during casting.

The novel combination of the above-described steps of (1) melting a chrome alloy in a manner which substantially excludes or substantially eliminates carbon, oxygen and nitrogen, (2) hot-working the resulting cast ingot to form a wrought shaped piece and (3) preferably coating the wrought piece cut therefrom with glass prior to fusion of the alloy for final casting in a heated mold brings to the dental art a degree of quality control heretofore unattainable in the fabrication of dental appliances from chrome alloys, resulting in a superior casting, particularly with regard to ductility, workability and finishing ability.

DESCRIPTION OF THE DRAWING

The accompanying drawing is a schematic representation of the preferred processing steps of the present invention as described hereinabove.

DESCRIPTION OF PREFERRED EMBODIMENTS

The following examples are provided for the purpose of illustrating, without limitation, the process and product of the present invention.

EXAMPLE I

The alloy E Bright 26-1, manufactured and sold by Airco, Inc., is suitable for use in the present invention. This composition is refined in an electron beam hearth to the following specifications:

Carbon: 0.1 max
Manganese: 0.40 max
Phosphorus: 0.02 max
Sulphur: 0.02 max
Silicon: 0.40 max Nickel and Copper: 0.50 max
Chromium: 25.0–27.5
Molybdenum: 0.75–1.50
Copper: 0.2 max
Nitrogen: 0.015 max
Iron: balance
Melting Range: 2700°–2750° F.
Coefficient of Expansion: 5.9–91 to 223° F.

The ingot is then hot worked to yield a wrought shape having the following tensile properties:
Ultimate Tensile Strength: 70,000 psi
Yield Strength 0.2%: 50,000 psi
Elongation: 30–40%
Reduction of Area: 70–80%
Brinell Hardness Number (BHN): 190

The wrought shape is then cut into small pieces suitable for dental laboratory casting by mechanical means such as shearing.

EXAMPLE II

The small pieces obtained according to Example I are individually coated with water glass by dipping them into an aqueous Be 40–42 solution of sodium silicate. The wet pieces are then withdrawn from the solution and air dried with application of heat.

EXAMPLE III

Incoloy 825 is a nickel/chromium alloy and sold by International Nickel Company. This material is commercially produced by argon-oxygen decarburization melting to approximately the following specifications:
Nickel: 42.0%
Carbon: 0.03
Manganese: 0.50
Iron: 30.00
Sulphur: 0.015
Silicon: 0.25
Copper: 2.25
Chromium: 21.5
Titanium: 0.10
Molybdenum: 3.00
Melting Range: 2500°–2550° F.
Coefficient Expansion: 7.8°–70° to 200° F.

This ingot is then hot worked to form a wrought piece having the following properties:
Ultimate Tensile Strength: 85,000–150,000 psi
Yield Strength 0.2%: 35,000–65,000 psi
Elongation: 50–30%
BHN: 120–180

The wrought piece is then sheared into smaller pieces which are then coated with glass in the manner of Example II. The resulting product is suitable for dental laboratory casting.

EXAMPLE IV

Inconel 625 is a chromium/nickel alloy manufactured and sold by International Nickel Company. This material is commercially produced by argon-oxygen decarburization melting to approximately the following specifications:
Nickel: balance
Carbon: 0.10
Manganese: 0.50
Iron: 5.00
Sulphur: 0.015
Silicon: 0.5
Chromium: 20–23
Aluminum: 0.40
Titanium: 0.40
Columbium and Tantalum: 3.15–4.15
Molybdenum: 8–10
Cobalt: 1.0
Phosphorus: 0.015
Melting Range: 2350–2460
Coefficient of Expansion: 7.1 70°–200° F.

This ingot is then hot worked to form a wrought piece having the following properties:
Ultimate Tensile Strength: 120,000–150,000 psi
Yield Strength 0.2%: 60,000–95,000 psi
Elongation: 60–30
BHN: 145–220

The wrought piece is then mechanically cut into smaller pieces which are coated with water glass in the manner of Example II. The resulting product is suitable for dental laboratory casting.

I claim:

1. A shaped hot-worked chromium-containing alloy piece of pre-determined size comprising at least about 20 percent by weight chromium and suitable for casting dental appliances and being essentially free of deleterious amounts of carbon, nitrogen and oxygen, said shaped hot-worked chromium-containing alloy piece of predetermined size being formed by:
   (a) fusing the chromium-containing alloy to form a melt in a heating means which substantially excludes the presence of carbon, oxygen and nitrogen from said melt;
   (b) pouring the melt obtained in step (a) into a mold to form an ingot;
   (c) hot-working the ingot obtained in step (b) to obtain an intermediate shaped piece; and
   (d) dividing the intermediate shaped piece obtained in step (c) into said shaped hot-worked chromium containing alloy pieces of pre-determined size, said hot-worked chromium-containing alloy piece of predetermined size being further characterized by being coated with glass derived from a water-soluble glass-forming compound, said coating step being conducted to minimize contamination with carbon, oxygen or nitrogen or other tramp elements during melting in dental laboratories preparatory to casting the alloy into dental appliances.

2. A shaped hot-worked chromium-containing alloy piece of pre-determined size according to claim 1 wherein:
   the chromium-containing alloy contains a metal selected from the group consisting of iron, nickel and cobalt; and the water-soluble glass-forming compound is selected from the group consisting of alkali metal silicates and alkali metal borates.

3. A shaped hot-worked chromium-containing alloy piece of pre-determined size according to claim 2 wherein:
   the chromium-containing alloy contains at least about 20 percent by weight chromium; and the water-soluble glass-forming compound is sodium silicate or sodium borate.

4. A shaped hot-worked chromium-containing alloy piece of pre-determined size according to claim 3 wherein the chromium-containing alloy contains between about 20 percent and about 30 percent by weight of chromium.

5. A shaped hot-worked chromium-containing alloy piece of pre-determined size according to claim 2 wherein the chromium-containing alloy contains additionally a strengthening element selected from the group consisting of tungsten, molybdenum, columbium, tantalum, aluminum and titanium.

* * * * *